United States Patent [19]

Bissett

[11] Patent Number: 4,703,531

[45] Date of Patent: Nov. 3, 1987

[54] PADDED RAIL CAP

[75] Inventor: Glenn Bissett, Asheville, N.C.

[73] Assignee: B. J. Mountain, Inc., Asheville, N.C.

[21] Appl. No.: 912,836

[22] Filed: Sep. 29, 1986

[51] Int. Cl.[4] ..... A47C 21/00; A47C 31/00; A68G 5/00; A47B 95/00

[52] U.S. Cl. ..... 5/508; 5/451; 248/118; 248/345.1

[58] Field of Search ..... 5/508, 451; 248/118, 248/345.1

[56] References Cited

U.S. PATENT DOCUMENTS

| | | | |
|---|---|---|---|
| 1,374,907 | 4/1921 | CoFrode | 248/118 X |
| 1,756,694 | 4/1930 | Loehr | 248/118 X |
| 2,564,386 | 8/1951 | Webb | 5/93 R |
| 3,327,328 | 6/1967 | Slivoski | 5/508 X |
| 4,089,497 | 5/1978 | Miller et al. | 248/118 X |
| 4,109,887 | 8/1978 | Wakeland, Jr. | 5/508 X |
| 4,514,871 | 5/1985 | Fisher et al. | 5/508 |
| 4,521,056 | 6/1985 | Lindenmuth | 248/118 X |
| 4,554,039 | 11/1985 | James | 5/508 X |
| 4,667,358 | 5/1987 | Penterman | 5/508 |
| 4,672,698 | 6/1987 | Sands | 5/508 X |

FOREIGN PATENT DOCUMENTS

| | | | |
|---|---|---|---|
| 2734049 | 2/1979 | Fed. Rep. of Germany | 297/488 |
| 1138138 | 6/1957 | France | 5/93 R |

OTHER PUBLICATIONS

Horizon Mfg. Catalog, *Waterbed Rail Caps.*

Indvik, Kurt; *Cap Off Your Waterbed Sales With Padded Rails;* Flotation Sleep Industry Mag.

Waterbed Magazine; *Padded Rails;* Dec. 1985; pp. 32–33.

*Primary Examiner*—Alexander Grosz

*Assistant Examiner*—Carl M. DeFrance, Jr.

*Attorney, Agent, or Firm*—David M. Carter

[57] ABSTRACT

There is provided a padded rail which is particularly adapted to be received over a support beam for a water bed. An elongated U-shaped channel is provided having a pair of detends extending inside of the channel for holding the rail to the beam. A pair of extensions project away from the side of the channel and a pair of wooden blocks are received on the extensions and are adjacent to the sides of the channel. Padding covers the top and sides of the channel. The entire structure, except for the opening in the channel, is surrounded by a protective cover and the structure is held together by a plurality of staples, which pass through the cover, the extensions, and are retained by the blocks.

8 Claims, 4 Drawing Figures

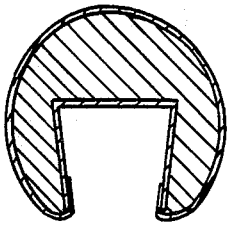
FIG. 1: PRIOR ART
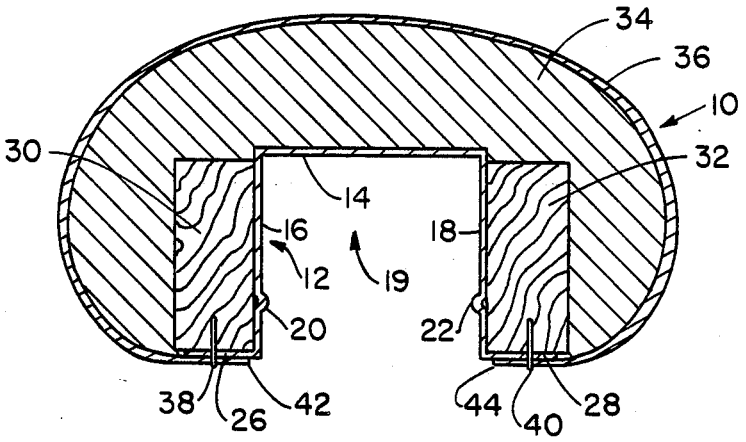
FIG. 2
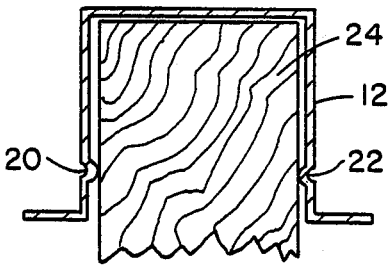
FIG. 3
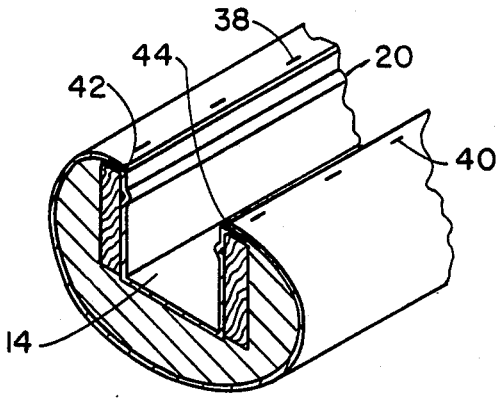
FIG. 4

PADDED RAIL CAP

BACKGROUND OF THE INVENTION

This invention relates to padded rails. More particularly, it relates to padded rails which are particularly useful in conjunction with water beds.

Water beds basically comprise a large bag filled with water and support beams which surround the bag on four sides. The beams normally comprise a plurality of 2×10's. The upper edges of the 2×10's formed the top surfaces of the sides of the early water beds. It was found that the narrow hard surfaces of the 2×10's were uncomfortable to the user, particularly when getting in and out of the bed and furthermore were aesthetically unattractive. A solution to this problem came about by the development of padded rails used on the long sides of the water beds and often used at the foot and sometimes at the head of the bed.

The standard padded rail includes three elongated pieces of particle board or other wooden material which are affixed together forming a U-shaped channel. The particle board is then surrounded with foam rubber padding and a cover made of a material such as vinyl is received over the padding and affixed to the particle board normally by the means of staples. While the particle board-type padded rail enhances the attractiveness and comfort of the water bed, it has several drawbacks. First of all, the particle board tends to mar the surface of the support beams of the bed and secondly, the particle board was rather heavy and thus the padded rails were rather cumbersome to use and the shipping costs were rather high. Furthermore, because of the high weight, the product did not lend itself well for direct sales to consumers.

U.S. Pat. No. 4,554,039 issued to Max James represents, in certain respects, an improvement over the old particle board-type padded rail. The James padded rail, which is shown in FIG. 1, utilizes a U-shaped channel made from lightweight polyvinylchloride (PVC) in lieu of the particle board; however, because the PVC channel would not readily hold staples, the vinyl covering was glued to the inside of the channel. One major drawback to this construction is that it has been found that the glue does not readily hold the vinyl covering to the PVC channel over a period of time, resulting in peeling of the vinyl covering from the channel which can cause the structure to come apart and is otherwise unsightly. Also, the James rail has a rather high profile which causes problems for a person getting into and out of the bed. Furthermore, in order to provide a mechanism to hold the padded rail to the beam, the PVC channel was biased inwardly from the top of the channel towards the opening in the channel. That type of construction requires close manufacturing tolerance so that the channel is not over-biased or under-biased, thus increasing the cost of manufacturing and further often resulting in ununiform products.

OBJECTS OF THE INVENTION

It is therefore one object of this invention to provide an improved padded rail.

It is another object to provide an improved padded rail which is particularly useful with water beds.

Another object is to provide an improved padded rail for water beds which is lightweight and presents a low profile.

It is still another object to provide an improved padded rail for water beds which is simple to manufacture.

SUMMARY OF THE INVENTION

In accordance with one form of this invention, there is provided a padded rail which is adapted to be received over a beam which in the preferred embodiment forms part of a water bed. The rail includes an elongated channel having a top and a pair of sides extending from the top and an opening formed thereby. The channel receives a portion of the beam. A mechanism is provided on the inside of the channel for securing the rail to the beam. A pad surrounds the top and sides of the channel and a mechanism is provided for securing the pad to the channel. Preferably the mechanism for securing the rail to the beam includes a pair of elongated indentations which are integral with the channel and extend into the inside of the channel.

Another feature of the invention provides for the use of a pair of blocks which rest on a pair of extensions which project from the ends of the sides of the channel. A cover is normally provided over the pad with the ends of the cover adjacent to the extensions. Staples or other securing means are driven through the cover, extensions and into the blocks. By the use of the blocks, the padded rail becomes spread out, thus presenting a lower profile and more comfortable rail.

BRIEF DESCRIPTION OF THE DRAWINGS

FIG. 1 is a cross-sectional side elevational view of a prior art padded rail.

FIG. 2 is a cross-sectional side elevational view of the padded rail of the subject invention.

FIG. 3 is a cross-sectional side elevational view of the channel from the rail of FIG. 2 showing the channel attached to a beam.

FIG. 4 is a partial perspective view showing the bottom of the padded rail.

DESCRIPTION OF THE PREFERRED EMBODIMENT

Referring now more particularly to FIG. 2, there is provided padded rail 10 which includes a one-piece U-shaped elongated channel 12 which in the preferred embodiment is made of a rigid thermoplastic plastic such as PVC. Channel 12 includes top 14 and sides 16 and 18 which extend from the top at approximate right angles thereto. By utilizing a substantially square or right-angled channel, manufacturing processing is much easier and cheaper, since most dies for forming such a channel are right-angled.

Channel 12 further includes a pair of indentations 20 and 22 which, in the preferred embodiment, are integral with sides 16 and 18 and extend into the inside of channel 12.

As can be seen from FIG. 3, the indentations abut against beam 24, which forms a part of a water bed, for securing the channel and thus the remainder of the padded rail onto the beam 24. Beam 24 may be a single board such as a 2×10 or it may be the combination of a board and a liner.

Referring again to FIG. 2, Channel 12 also includes a pair of extensions 26 and 28 which project from the ends of sides 16 and 18 respectively. A pair of elongated blocks 30 and 32 rest on extensions 26 and 28 and abut against the sides 16 and 18 along the length of the channel. In the preferred embodiment, blocks 30 and 32 are made of particle board; however, the blocks may be made of any suitable material which will hold a staple, a nail, or the like in place. However, preferably blocks 30 and 32 are made of lightweight material so that the overall structure is lightweight.

The blocks and the top 14 of the channel are surrounded by foam padding 34. The foam padding, in turn, is surrounded by a protective cover 36 which in the preferred embodiment is made of vinyl with a non-woven backing. The cover could be made of other materials such as velvet or other fabric. The ends of cover 36 are under extensions 26 and 28 but preferably do not extend into opening 19 of the channel.

Fastening means 38 is received through the cover 36, extension 26 and into block 30 where it is held in place. Fastening means 40 is also received through cover 36, extension 28 and block 32. Preferably, fastening means 38 and 40 are staples, since they are easy and inexpensive to use. The staples may be more readily seen in reference to FIG. 4 where a plurality of staples are shown to be spaced apart along each side of the elongated rail, each of which are held in place by elongated blocks 30 or 32.

As can be seen, the use of the blocks 30 and 32 widen the rail and thus present a lower overall profile over that of the prior art shown in FIG. 1. Furthermore, by stapling to the cover, to the channel and to the blocks, there is no need to utilize the glue which was used in the prior art shown in FIG. 1 which often resulted in the peeling of the cover from the channel.

As can be seen in FIG. 4, the edges 42 and 44 of the cover do not extend into the opening 19 of the channel, thus not interfering with the attachment of the rail to the beam.

Thus, there is provided a lightweight and easy to manufacture padded rail which overcomes the problems of the prior art.

From the foregoing description of the preferred embodiment of the invention, it will be apparent that many modifications may be made therein without departing from the true spirit and scope of the invention.

I claim:

1. A padded rail adapted to be received over a beam comprising:

an elongated channel having a top and a pair of sides extending from said top and an opening formed thereby;

said channel adapted to receive a portion of the beam;

a pair of extensions connected to each of said sides on the ends of said sides removed from the top; said extensions projecting substantially perpendicular from said sides away from the opening in said channel;

a pair of rigid elongated blocks resting on said extensions and adjacent to the respective sides of said channel;

a pad surrounding said blocks and said top of said channel;

a cover surrounding said pad and being in contact with said extensions;

means for securing said cover to said channel; an indentation formed in each of said sides projecting into said channel.

2. A padded rail as set forth in claim 1 wherein said indentations are integral with said channel.

3. A padded rail as set forth in claim 1 wherein said sides meet said top at substantial right angles to one another.

4. A padded rail as set forth in claim 1 wherein said means for securing said pad to said channel further includes a plurality of staples extending through said cover and through said extensions into said blocks.

5. A padded rail as set forth in claim 1 wherein said blocks are made from particle board.

6. A padded rail as set forth in claim 1 wherein said channel is made of polyvinylchloride.

7. A padded rail as set forth in claim 1 wherein said pad is made of foam rubber.

8. A padded rail is set forth in claim 1 wherein said means for securing includes a plurality of staples, portions of which project through said pad and said extensions and into said blocks.

* * * * *